US005788362A

United States Patent [19]

Chou

[11] Patent Number: 5,788,362

[45] Date of Patent: Aug. 4, 1998

[54] LIGHT STRING FIXING STRUCTURE

[76] Inventor: Tsung-Ming Chou, 1 Lane 328, Chung Hsin Road, Sec. 3, Chu-Tung Haian, Hsin Chu Hsien, Taiwan, 310

[21] Appl. No.: 820,544

[22] Filed: Mar. 19, 1997

[51] Int. Cl.[6] ..... F21V 21/00

[52] U.S. Cl. ..... 362/249; 362/252; 362/806; 362/432

[58] Field of Search ..... 362/249, 252, 362/147, 806, 432

[56] References Cited

U.S. PATENT DOCUMENTS

| | | | |
|---|---|---|---|
| 3,927,315 | 12/1975 | Werry | 362/249 X |
| 5,161,881 | 11/1992 | Myson | 362/249 |
| 5,446,640 | 8/1995 | Lin | 362/407 |
| 5,513,081 | 4/1996 | Byers | 362/252 X |
| 5,526,250 | 6/1996 | Ting et al. | 362/391 |
| 5,584,567 | 12/1996 | Rumpel | 362/249 |

*Primary Examiner*—Ira S. Lazarus
*Assistant Examiner*—Nhat-Hang H. Lam
*Attorney, Agent, or Firm*—David E. Dougherty

[57] ABSTRACT

Disclosed is a light string fixing structure which mainly includes a fixing seat and a lampholder detachably connected to the fixing seat. The fixing seat can be fixedly mounted onto a desired position by extending a nail or screw through a centered hole of the fixing seat into a wall surface or by glue or double-side adhesive tape. The lampholder is provided around a rear end with a flange and the fixing seat is provided around a periphery with claws, such that when the lampholder is backward pushed into the fixedly mounted fixing seat, it is retained in place in the fixing seat by the engagement of the claws with the flange. Whereby light strings using the fixing structure can be easily installed to form desired patterns and lamps connected to the lampholders contained in the light strings are protected from swinging or colliding and broken caused by wind or an outcoming force.

1 Claim, 7 Drawing Sheets

LIGHT STRING FIXING STRUCTURE

BACKGROUND OF THE INVENTION

The present invention relates to a light string fixing structure, and more particularly to a light string fixing structure which can be easily installed to effectively protect lamps of the light string from broken due to swinging and collision caused by wind or an outcoming force.

A conventional light string usually comprises multiple serial-connected lamps and lampholders. Each of the lamps is connected to one lampholder. Some of the lampholders are provided with clip means for the light string to fix onto a twig or a cord, so that the light string can be loosely wound round a tree or attached to a wall surface as a decoration. There is not other better means to stably fix a conventional light string in place. FIG. 6 illustrates a conventional method to mount a light string. As shown, a layout on a board is first decided. Then, holes are drilled on the board according to the layout. Wires are threaded from a back of the board and through the holes to connect lampholders with lamps. Finally, put the lampholders into the holes. The drawbacks of this method include: a) it is inconvenient to drill holes; b) it is uneasy to control the length of wires; c) the lampholders tend to move in the holes and lamps connected to the lampholders are subject to collision and crack when there is a high wind, for example, and any damaged or burned lamps in the light string shall adversely affect the whole beauty of the light string; and, d) the fixing method is not suitable for use on a cement wall. To mount a light string on a cement wall or any other hard wall surface, nails or other fastening means are required and the light string can only be loosely hung on the wall in an unstable manner, as the top line of string shown in FIG. 5. In case of any blow, the lamps are subject to collision with each other or with the wall surface and undesirable break of bulbs shall occur.

It is therefore tried by the inventor to develop a light string fixing structure to eliminate the drawbacks existed in the conventional light string.

SUMMARY OF THE INVENTION

A primary object of the present invention is to provide a light string fixing structure which is easy and convenient to install and can effectively and stably fix the the light string and the lamps thereof in place.

The light string fixing structure according to the present invention mainly includes a lampholder and a fixing seat. The lampholder and the fixing seat is provided with engaging means to detachably connect with each other. To mount the light string, first install the fixing seat on a desired position. Then, engage the lampholder with the fixing seat with the help of the engaging means provided on them. By this way, the light string fixing structure can be easily and firmly installed and fixed at any desired place and lamps connected thereto are not subject to swing, collision and break due to wind.

BRIEF DESCRIPTION OF THE DRAWINGS

The detailed structure of the present invention and the technical means adopted by it to achieve the above and other objects can be best understood from the following detailed description of the preferred embodiment and the accompanying drawings, wherein.

DETAILED DESCRIPTION OF THE PREFERRED EMBODIMENTS

Figure 1:
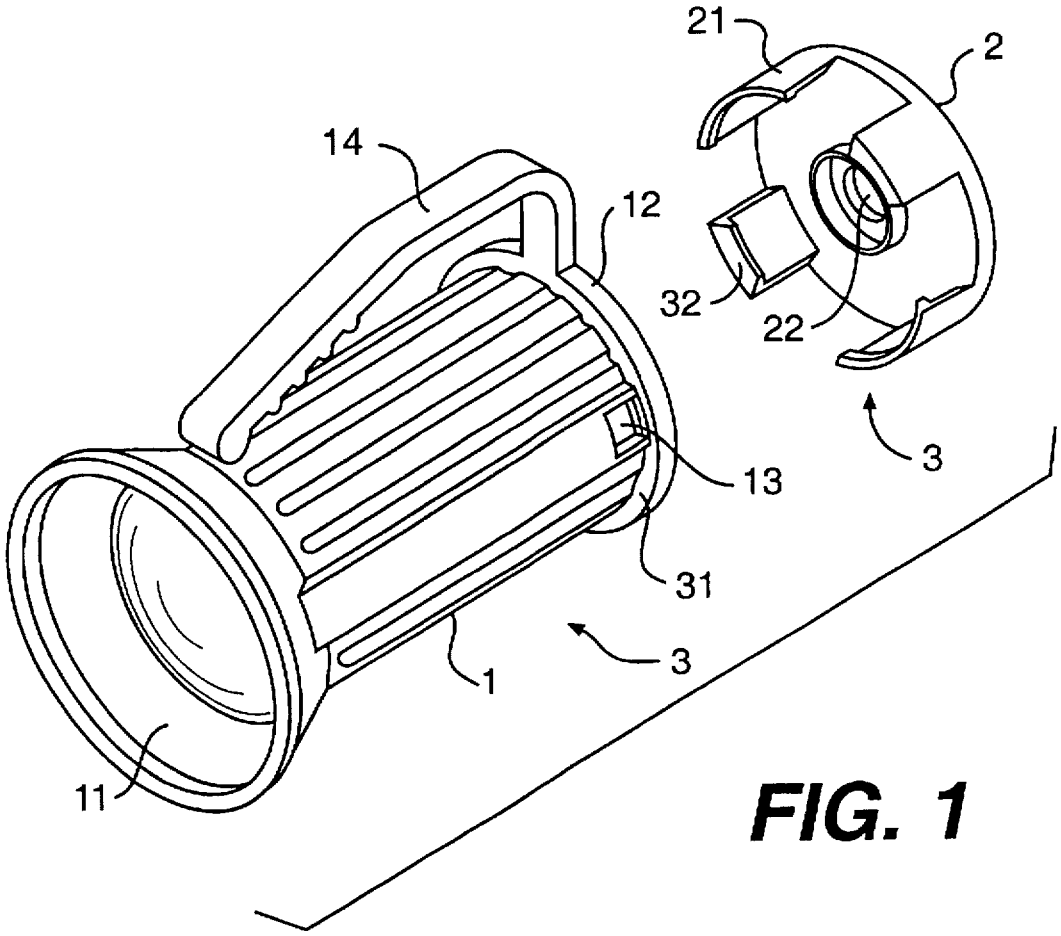
FIG. 1 is an exploded perspective of the present invention.
Figure 2:
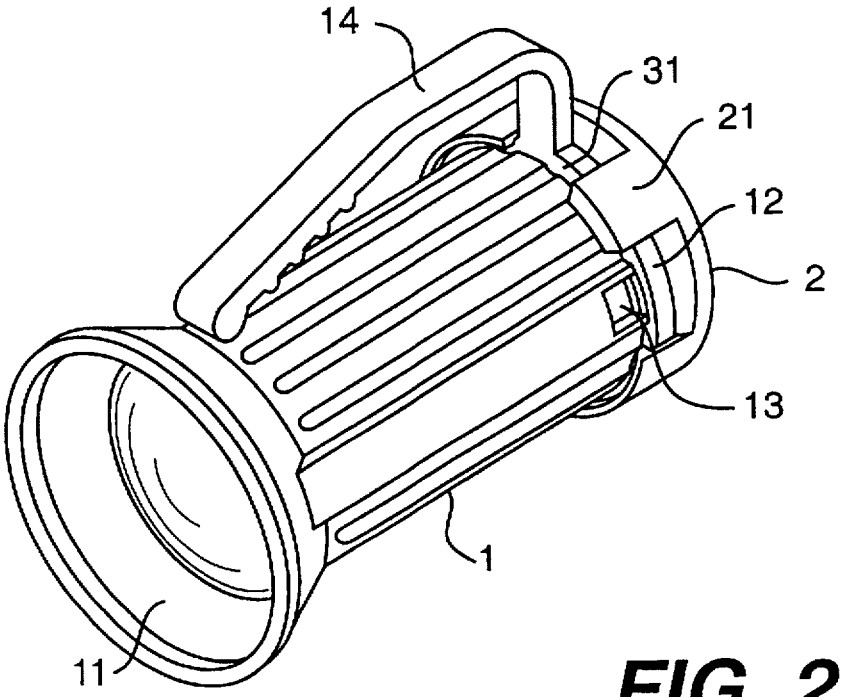
FIG. 2 is an assembled perspective of the present invention.

Please refer to FIGS. 1 and 2. The present invention relates to a light string fixing structure which mainly includes a lampholder 1 and a fixing seat 2.

The lampholder 1 is a generally cylindrical body having a front opening 11 for receiving a lamp 4 therein. The lampholder 1 is provided on a side wall near a rear end with a wiring hole 13 for wires to pass through and a clip 14 for holding the lampholder 1 and accordingly the lamp 4 on a twig or a cord. A flange 31 is formed around a rear base 12 of the lampholder 1.

The fixing seat 2 is a generally round plate having a centered short hollow cylinder and at least two forward extended claws 21 spaced around an outer periphery of the plate. A fixing hole 22 is formed on the plate within the hollow cylinder. The claw 21 each is provided at a top with an inward extended hook portion 32. When the lampholder 1 is backward pushed into the fixing seat 2, it is retained thereto by the claws 21 with the flange 31 held by the hook portions 32 of the claws 21, forming a fixing assembly 3.

Figure 3:
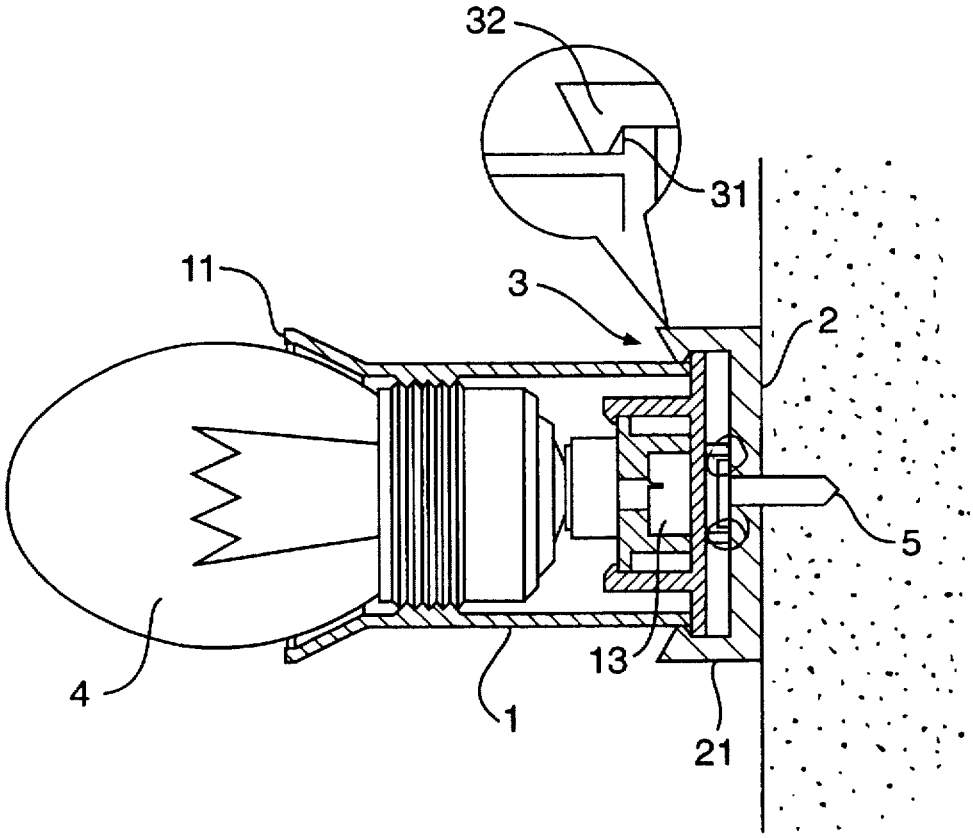
FIG. 3 is a side sectional view of the present invention mounted on a wall.
Figure 4:
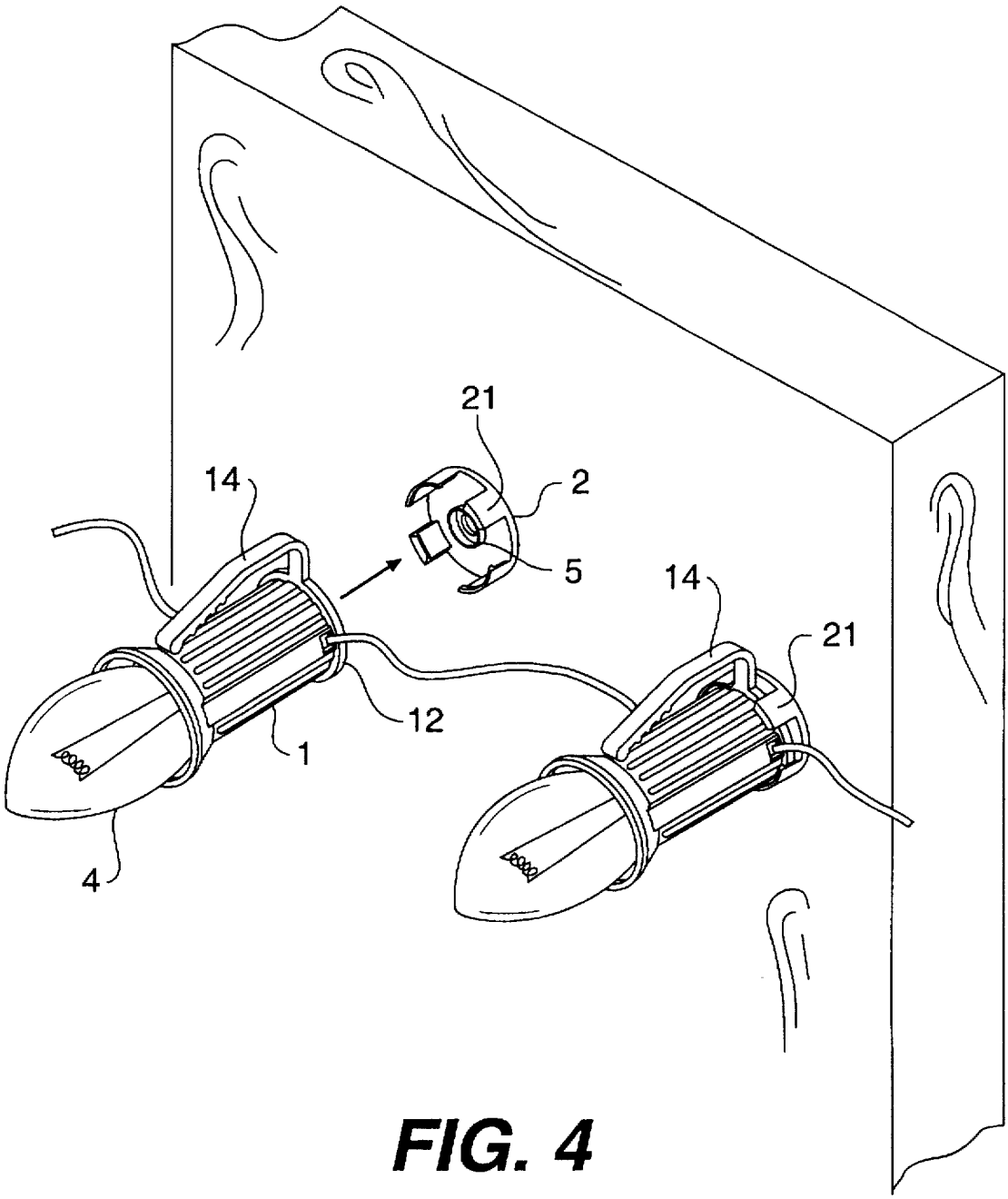
FIG. 4 is a perspective view showing the manner in which a light string with the present invention is mounted on a surface.

Please refer to FIGS. 3 and 4 for attachment of a light string to a wall surface, etc. by means of the present invention. First, attach the fixing seat 2 to the wall surface according to the predetermined layout by threading a screw or hitting a nail 5 through the central fixing hole 22 and into the wall surface. Second, lead wires into the lampholder 1 by way of the wiring hole 13 to complete the electrical connection. Then, screw the lamp 4 into the front opening 11 of the lampholder 1. Thereafter, push the rear base 12 of the lampholder 1 into the fixing seat 2 until the flange 31 around the rear base 12 passes the hook portions 32 of the at least two claws 22 of the fixing seat 2 and is retained thereto, allowing the entire lampholder 1 to be firmly held in the fixing seat 2 without being easily swung by wind or any other outcoming force to collide with each other and cause broken bulbs 4.

In another embodiments, a glue gun or a double-side adhesive tape can be used to replace the nail or screw 5 in attaching the fixing seat 2 to a wall surface in a faster and more convenient manner.

Figure 5:
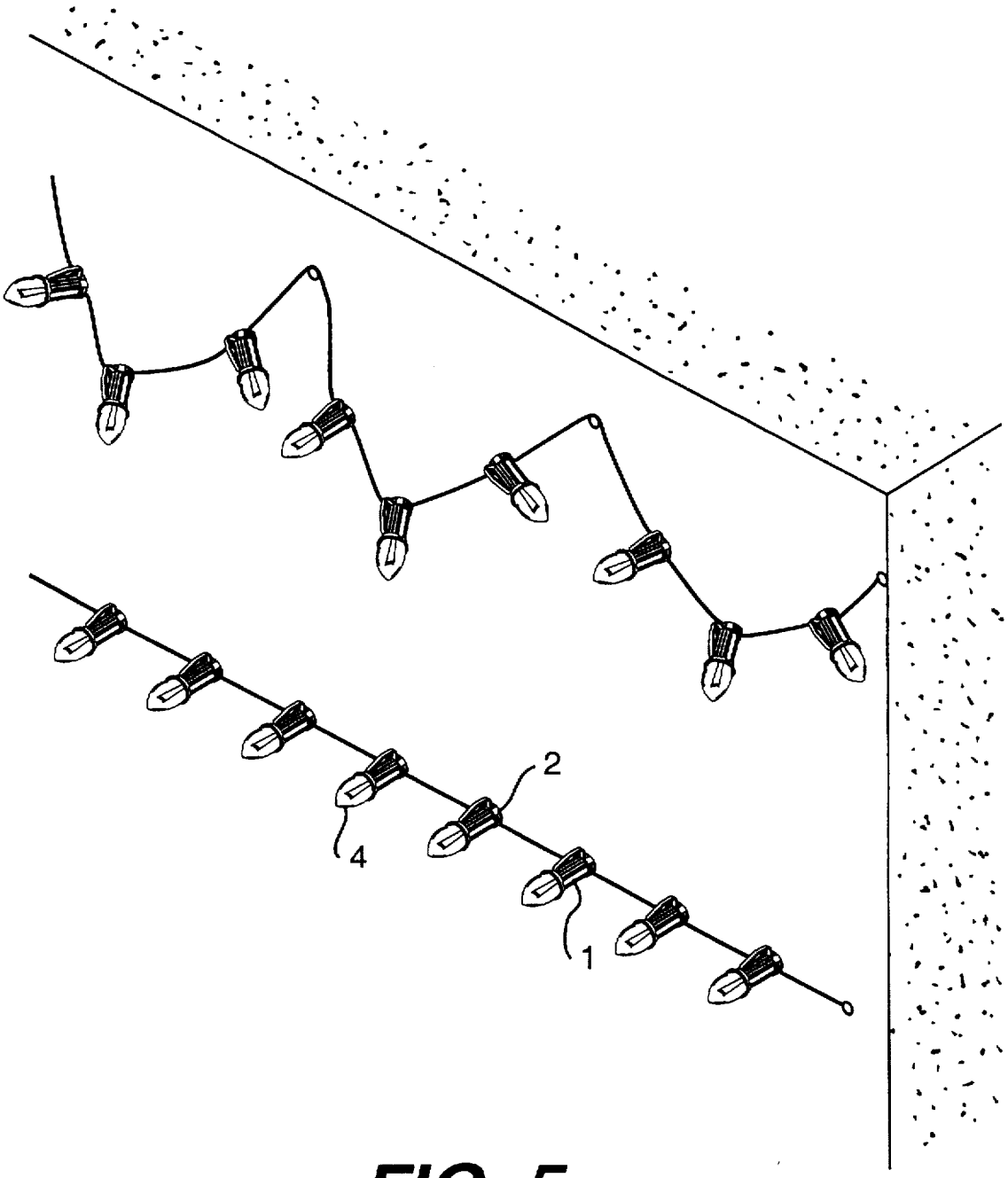
FIG. 5 compares a light string using the present invention (the lower string) with a conventional light string (the upper string) mounted on a wall.
Figure 6:
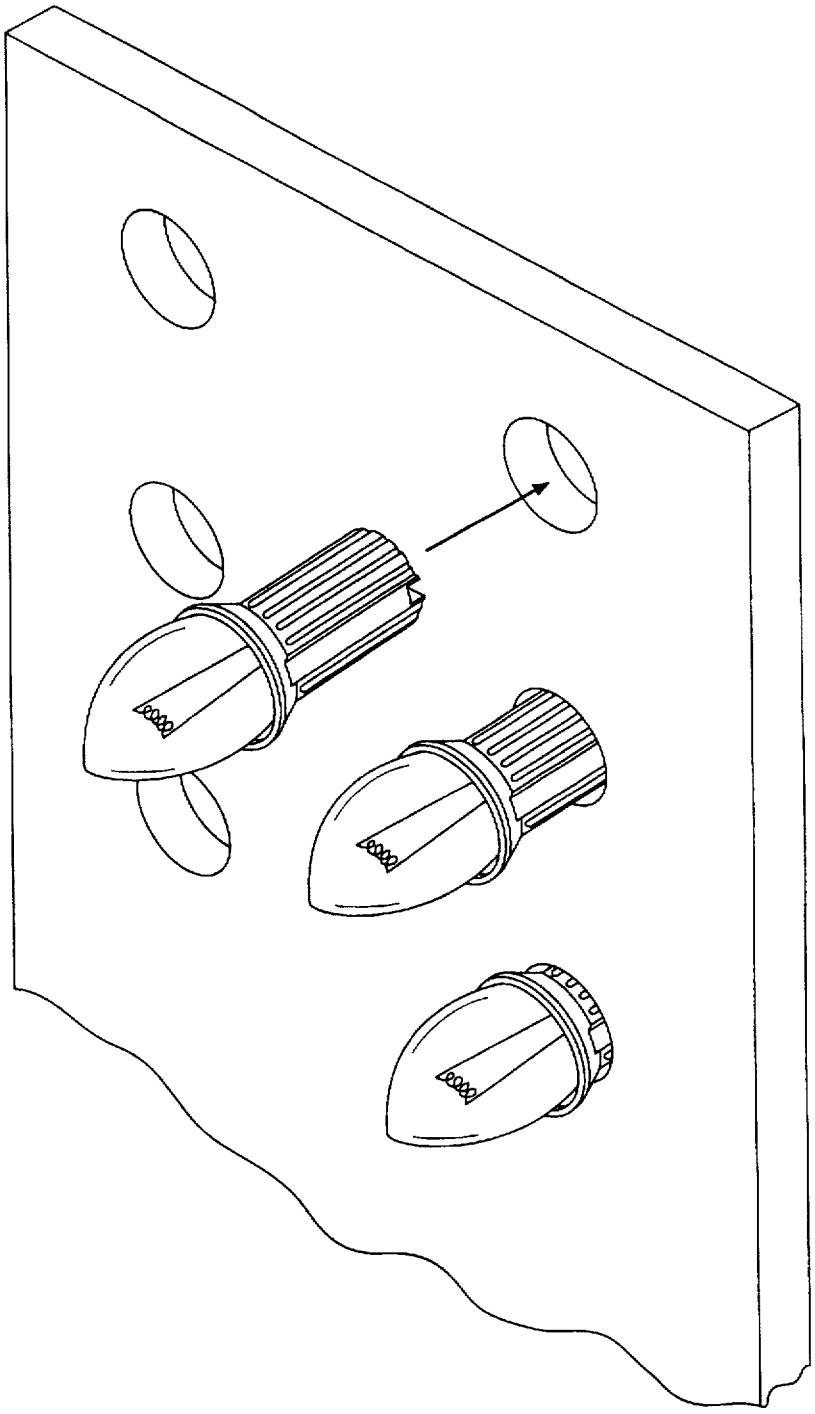
FIG. 6 illustrates the manner in which the conventional light string is mounted on a surface.

As shown in FIG. 5, the lower line of light string including lamps 4 and lampholders 1 and fixing seats 2 according to the present invention can be orderly and fixedly attached to any surface in a straight line instead of being loosely and disorderly hung from the nails or screws on the surface like the upper conventional light string in FIG. 5. The lamps 4 on the fixedly installed light string are therefore protected from broken caused by swinging and colliding with each other. The present invention also allows various patterns to be created from multiple differently but orderly mounted light strings.

Figure 7:
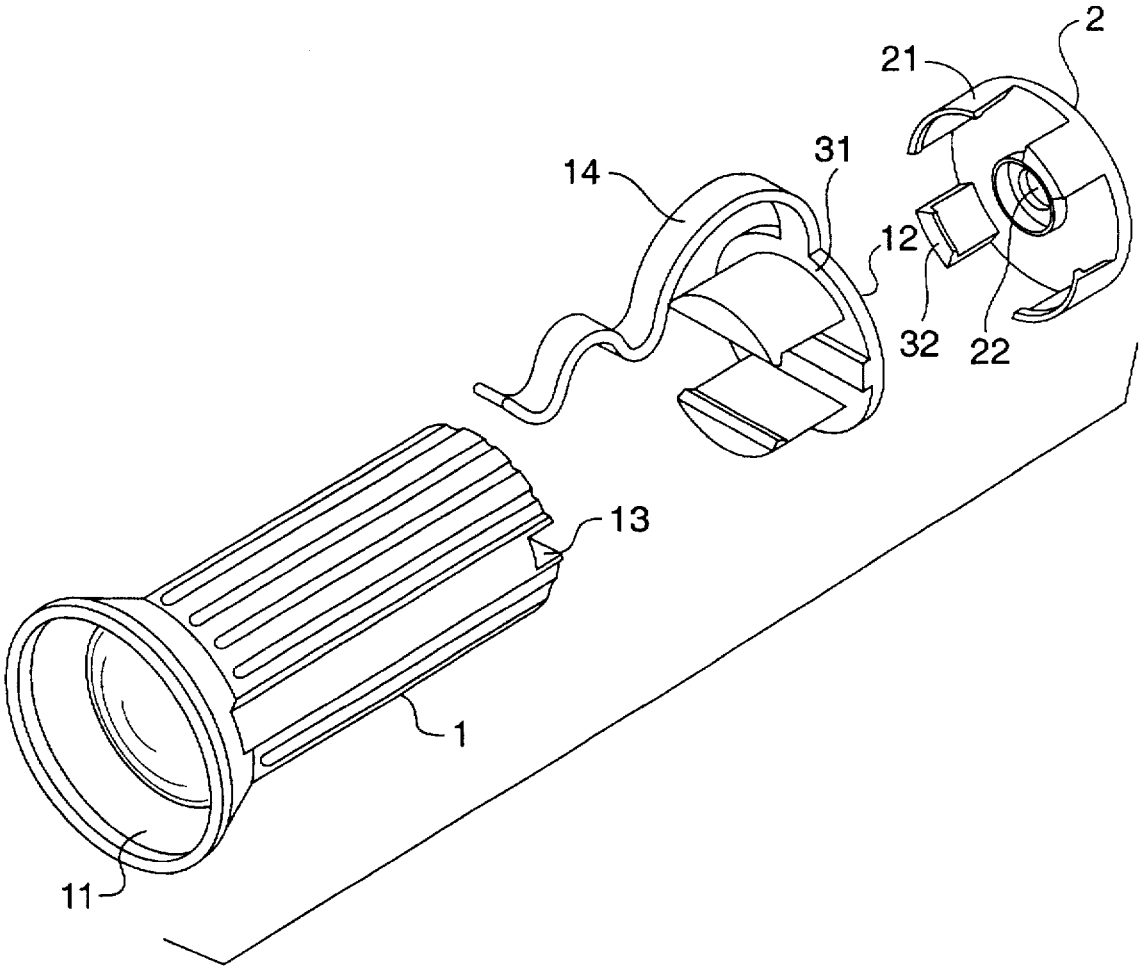
FIG. 7 is an exploded perspective showing another embodiment of the present invention.
Figure 8:
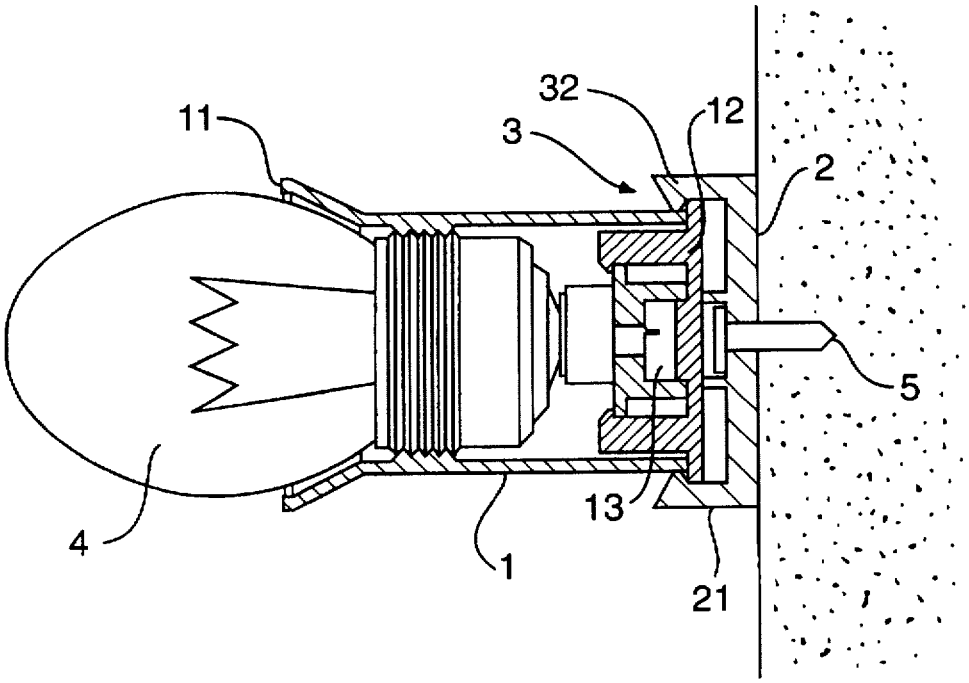
FIG. 8 is a side sectional view of the embodiment of FIG. 7.

FIGS. 7 and 8 illustrate another embodiment of the present invention. In this embodiment, the lampholder 1 and the rear base 12 thereof are two separate pieces detachably snapped together, so that the wiring hole 13 on the side wall of the lampholder 1 is actually a cut before the lampholder 1 and the rear base 12 are assembled together. This will make the wire connection more convenient without the need to lead the wires into the lampholder 1 to connect the wires in a very small space inside the lampholder 1. And, the clip 14 is designed to include more than one arcuated portion with different curvature of radius, so that the light string can be conveniently fixed to a twig or a cord of different thickness by means of the clip 14.

With the above arrangements, following advantages can be found from the present invention:

1. The lampholder and the fixing seat are separate members. The fixing seats can be independently fixed to the desired positions one by one before the lampholders are connected to the fixing seats. Thereby, the light string can be easily mounted to save a lot of time and labor.
2. With the light string fixing structure of the present invention, multiple light strings can be used to create more orderly and beautiful patterns and the lamps thereof are not subject to swinging or collision and breaking caused by wind. The failure and maintenance of light strings in use can therefore be effectively reduced.
3. In case of any failure is found on any part of any light string, simply apply a force on the lampholder of the failed lamp to pull the same out of the fixing seat. After the reason causing the failure is removed, the same lampholder can be quickly pushed into the same fixing seat again. The repair and maintenance of the light string becomes very convenient.
4. When the decorative light string is not in use, simply detach the lampholders and the lamps from the low-cost fixing seats and discard the latter. The dismounted lampholders and lamps can be stored for use in the future to avoid unnecessary waste.

In brief, the light string fixing structure according to the present invention has simple structure which allows easy installation and reduced rate of failure and therefore lower costs for manufacture, mounting, and maintenance. Moreover, the light string fixing structure of the present invention allows various orderly and beautiful patterns to be created from linear light strings and therefore increases the economical benefit of the decorative light strings.

Although the present invention has been described with he preferred embodiments thereof, it should be noted that the present invention is not limited to such embodiments and various changes can be made without departing from the spirit of the present invention or the scope of the subjoined claims.

What is claimed is:

1. A light string fixing structure comprising a base member, a plurality of fixing seats and means for mounting said fixing seats on said base member in predetermined positions, said fixing structure including a plurality of lamp holders and means for detachably mounting lamp holders on said fixing seats, each of said lamp holders comprising a generally cylindrical body having a front opening for receiving a lamp therein, a wiring hole in a side thereof, and a closed rear base with an outwardly extending flange extending around a periphery of said rear base; and wherein each of said fixing seats is a generally round plate member comprising a centered upwardly extending short hollow cylinder having an upper portion and a bottom with a centered fixing hole provided at said bottom thereof for fixing said fixing seat to said base member and said means for detachably mounting said lamp holders on said fixing seats comprising at least two forwardly extending claws formed in said upper portion of each of said upwardly extending hollow cylinders and each of said claws including an inwardly extending hook portion for engaging said flange of said lamp holer.

* * * * *